United States Patent [19]

Baber

[11] 4,456,129

[45] Jun. 26, 1984

[54] LOAD SUPPORT FLANGES WITH COINED EDGES

[75] Inventor: R. Richard Baber, Greensboro, N.C.

[73] Assignee: Burlington Industries, Inc., Greensboro, N.C.

[21] Appl. No.: 283,725

[22] Filed: Jul. 15, 1981

[51] Int. Cl.[3] ..... A47F 7/00

[52] U.S. Cl. ..... 211/13; 211/44; 248/346; 248/DIG. 12

[58] Field of Search ..... 211/13, 44; 248/DIG. 12, 176, 346, DIG. 11; D6/56

[56] References Cited

U.S. PATENT DOCUMENTS

| | | | |
|---|---|---|---|
| D. 250,679 | 1/1979 | Gageby | D6/56 X |
| 1,105,855 | 8/1914 | Smith | 248/DIG. 11 |
| 2,275,968 | 3/1942 | Kissinger | 211/13 |
| 2,873,054 | 2/1959 | Zintel | 223/98 |
| 3,201,172 | 8/1965 | Bliss | 297/DIG. 2 |
| 3,730,472 | 5/1973 | Dale | 248/300 |
| 3,765,538 | 10/1973 | Kowert | 211/13 |
| 4,268,207 | 5/1981 | Pipes | 414/277 |

OTHER PUBLICATIONS

Selig Import Brochure, Item #640-11, (Mar. 23, 1973), p. D17C.

*Primary Examiner*—J. Franklin Foss
*Assistant Examiner*—David L. Talbott
*Attorney, Agent, or Firm*—Cushman, Darby & Cushman

[57] ABSTRACT

A universal load support device for supporting flat and cylindrically shaped articles of fabric or textile material having coined or beveled edges that do not impinge against the fabric or textile material forming the article so as to cause creases or other surface deforming conditions. The outer peripheral edges of that portion of the support device contacting the article are coined or beveled at an angle varying from about 5 degrees to about 20 degrees and the extreme outer edge is slightly rounded.

11 Claims, 4 Drawing Figures

LOAD SUPPORT FLANGES WITH COINED EDGES

FIELD OF THE INVENTION

The present invention relates to an improved type of support device or pad for supporting both flat and cylindrically shaped objects in the forms of other cartons or rolls in a rack storage system. The support device or pads are fabricated such that when directly supporting textile fabric, creases are not formed in that textile matrial.

BACKGROUND OF THE PRESENT INVENTION

In the textile industry, packages in many forms are used to enclose textile products and the most frequently used package form are cartons or more simply rolls of the textile product. These must be held or stored for certain periods of time while waiting for further processing or shipment and quite frequently the rolls of textile material may not be covered or only protected with a plastic wrap. It has been desirable to employ in storage areas a support device that would allow both flat and cylindrically shaped objects to be supported without having to dedicate specific portions of a storage system for one or the other type of container or product configuration. One such type of support is a gull wing type of support pad which is stamped or cast into that gull-wing shape. I have found, however, that such devices when directly supporting rolls of textile products, including rolls of fabrics and carpets, that support device will undesirably crease or damage the outer surface of the rolled textile material with this damage being effected most frequently by the peripheral edges of the support pads. In addition, I have found that the pads fabricated heretofore present problems of insufficient strength and rigidity for proper load support.

SUMMARY OF THE PRESENT INVENTION

The present invention is comprised primarily of a pad structure including a central flattened area from which two opposing surfaces slope upwardly and outwardly with those sloping surfaces terminating again in exterior flattened areas so that a gull wing shaped support pad is formed. Each of the marginal or peripheral edges of that support pad are coined or bent downwardly a predetermined amount so that the edge is beveled. I have found that this substantially eliminates creasing problems and also provides some increased rigidity to further increase the load bearing strength of the pad. The exterior edges that have been beveled or bent downwardly only a slight degree could be bent further to produce a fully flanged edge so as to form sides about the pads thereby creating a channel type structure. This significantly increases the load support capability for a given pad thickness.

In another embodiment, the pad structure as described above is formed in two pieces with each piece being in the form of a generally U-shaped member with the support flange portion and a base portion each extending out away from a vertical support section in the same direction. The support flange portion extends outwardly a greater distance than a base member thereof although this is not an essential requirement. Again, the peripheral edges of the support flanges themselves are beveled or coined so as to prevent damage to the fabric placed thereon.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE EXEMPLARY EMBODIMENT OF THE PRESENT INVENTION

Figure 1:
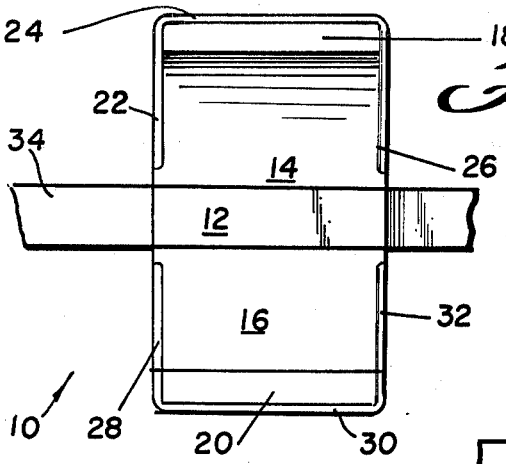
FIG. 1 is a diagrammatic top plan view of one embodiment of the present invention.
Figure 2:
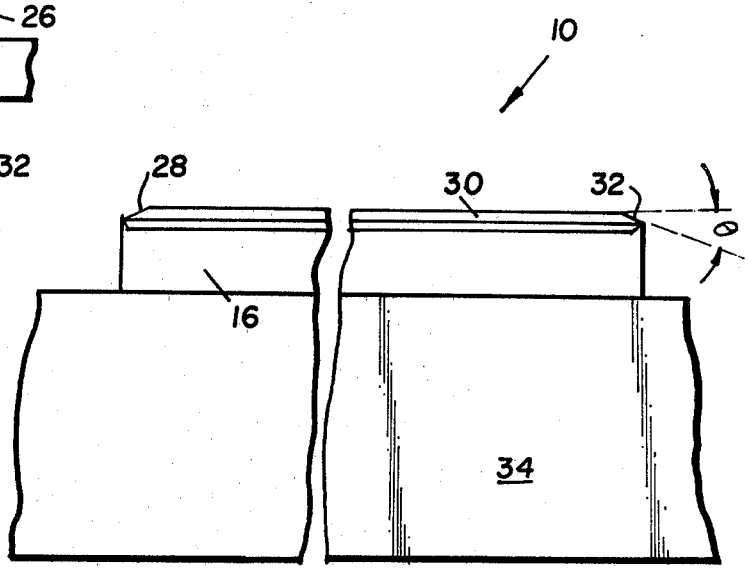
FIG. 2 is a side elevational view of the support pad shown in FIG. 1.
Figure 3:
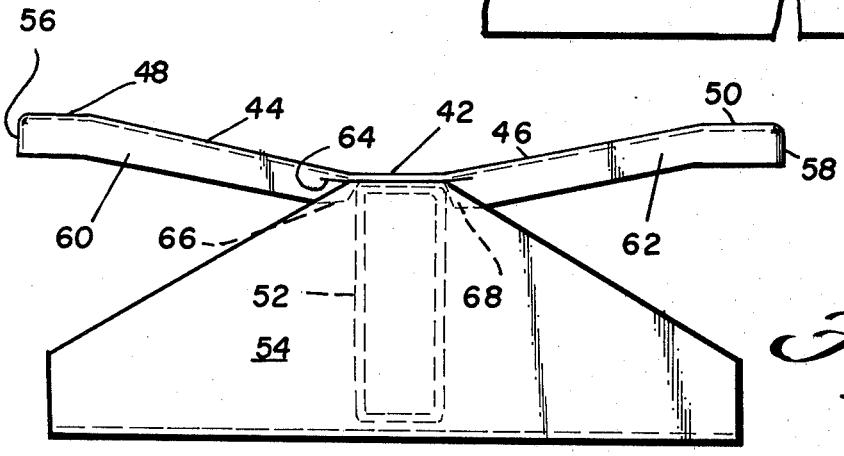
FIG. 3 is a diagrammatic front view of another embodiment of the present invention incorporating the features thereof.
Figure 4:
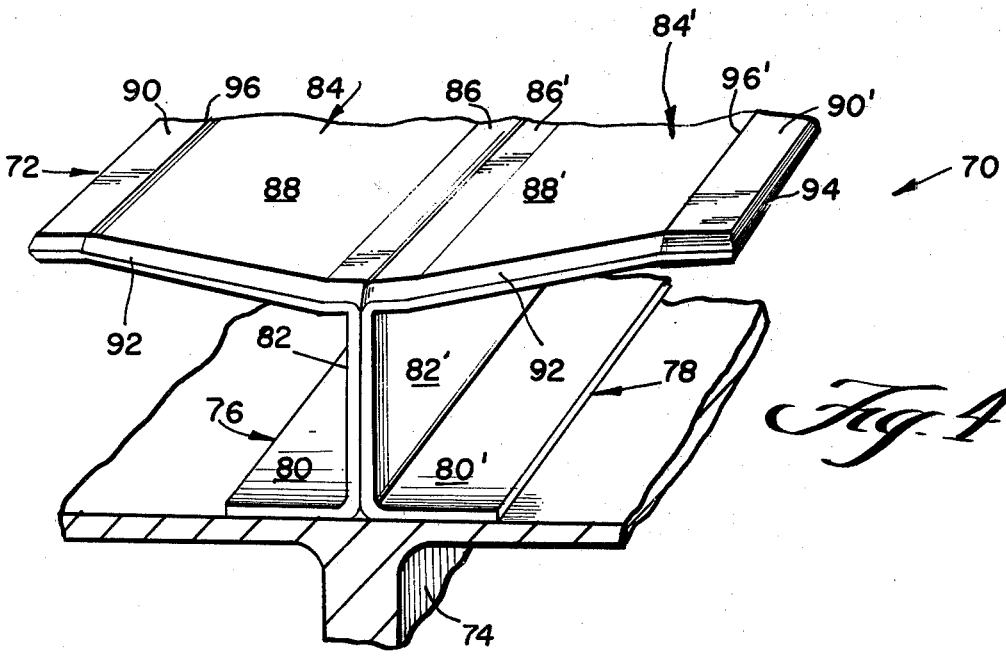
FIG. 4 is a diagrammatic perspective view of still another embodiment of the present invention also incorporating the features thereof.

Turning our attention first to FIGS. 1 and 2, it should be kept in mind that the overall shape of the support pad device generally indicated at 10 is as shown in FIGS. 3 and 4. That shape is produced by constructing the support pad with a horizontally extending central support section 12 from which surfaces 14 and 16 extend outwardly and upwardly at a predetermined angle, typically ranging from about 9 degrees to about 15 degrees and terminate at outer flat portions or areas indicated in FIG. 1 at 18 and 20, respectively.

In order to solve the problem of crease creation when support pads of this type are used, I have coined or beveled the outer edges with these coined portions being indicated for surfaces 14 and 18 by numerals 22, 24 and 26 and for surfaces 16 and 20 by numerals 28, 30 and 32. As shown in FIGS. 1 and 2, the horizontal central support section 12 is secured to a support beam 34 by any convenient means such as by welding, by rivets, or by bolts (not shown). It should also be noted that the pad indicated at 10 in FIG. 1 is a one-piece structure.

In FIG. 3, an alternative embodiment is shown wherein the device generally indicated at 40 also includes a center support section 42, two angled portions or surfaces 44 and 46, and outer flat support portions 48 and 50. The horizontal central section 42 is also secured to a support beam 52 by any convenient means. Also shown, is a support wall 54 located at each end of support beam 52 to attach that beam to a storage rack system to prevent twisting of beam 52. In order to further strengthen the device indicated at 40, as in FIG. 3, the outer peripheral edges of the support pad have been bent over so as to produce end flanges 56 and 58 and side flanges on each side of the support pad, two of which are indicated at 60 and 62. The central portion of the side flanges, such as between portions 60 and 62, has been cut, as indicated by cut line 64 and the cut portions have been bent inwardly so as to produce folded tabs 66 and 68 on each side. These tabs are folded inwardly a sufficient distance to create an opening in the side flange that is large enough to receive beam 52 therein. The portion of the side flanges can be cut at the exterior corners so that as the side flanges are folded they will join with the end flange and the two flange portions are preferably welded or otherwise secured together to form a relatively smooth joint thus assuring continuity in the strength of the pad in the corner areas. Again, the central section 42 can be welded or otherwise secured to the top of support beam 52.

With both the embodiments shown in FIGS. 1–3, the rigidity and holding ability is increased because of the bending of the edges. In the embodiments shown in FIGS. 1 and 2, bending of the edge downwardly from a horizontal direction occurs at an angle $\theta$ as shown in FIG. 2 with that angle ranging from about 5 degrees to about 20 degrees and I have found that the angle should preferably be about 10 degrees. In FIG. 3, the end and side flanges have been folded over 90 degrees so as to produce the greatest amount of supporting strength for the support pad itself.

The next embodiment, generally indicated at 70, is shown in FIG. 4 and is comprised of a support pad structure, generally indicated at 72, mounted to a support beam, generally indicated at 74.

Support pad 72 is formed of two generally U-shaped members 76 and 78 with each including a base portion 80 and 80', a vertical portion 82 and 82' and a flange support area 84 and 84'. Each support flange includes a flat center area 86 and 86', an angled surface 88 and 88' and a flattened exterior edge area 90 and 90'. In addition, each support flange is beveled about its peripheral edge in the same manner as described above for FIG. 1 with these coined or beveled portions being shown in FIG. 4 at 92 along the front edge and 94 along the side edge. Accordingly, these coined edges have also been bent down at an angle ranging from about 5 to about 20 degrees and preferably about 10 degrees rather than the 90 degrees as is shown in FIG. 3. This bending can be produced either by rolling the edges or preferably by a stamping process when members 76 or 78 are being formed. In addition, the top extreme edge along the support surface, generally indicated at 96 and 96', becomes slightly rounded and the rounding of edge 96 together with the creation of the coined edges 92 and 94 helps to minimize if not eliminate creasing problems experienced with other load devices.

While the invention has been described in connection with what is presently considered to be the most practical and preferred embodiments, it is to be understood that the invention is not to be limited to the disclosed embodiments but on the contrary, is intended to cover various modifications and equivalent arrangements thereof included within the spirit and scope of the appended claims, which scope is to be accorded the broadest interpretation so as to encompass all such modifications and equivalent structures.

I prefer to manufacture the support pads described herein from steel plate having a thickness ranging from about 0.2 cm to about 0.6 cm and stamping or otherwise molding to obtain the desired shape and edge configuration. However, it should be understood that the other material including aluminum, plastic or reinforced plastic could be employed in which case the pad could be cast or molded through the use of conventional casting and injection molding techniques. Cast aluminum pads would have a thickness ranging from about 0.3 cm to about 1.0 cm whereas support pads formed from plastic would vary in thickness from about 0.4 cm to about 1.5 cm.

What I claim is:

1. A load support device for supporting flat and round packages of textile products to prevent undesirable creasing or damage to the outer surface of the textile product, said device comprising a support pad having two diametrically opposed support flanges each having an outer flat portion, an inner flat portion spaced vertically below the outer flat portion and an angled portion connecting the outer and inner flat portion together, and support means for supporting said support pad wherein the outer peripheral edges of said support pad include means defining beveled edge portions for substantially preventing creasing of said textile product supported upon said support pad and for increasing the load bearing strength of said support pad, said beveled edge portions being beveled at an angle ranging from about 5 degrees to about 25 degrees wherein said support pad is comprised of two seperate generally U-shaped members each having a foot portion, a vertical support portion having upper and lower areas and an upper support flange portion with each of said upper support flange and foot portions extending outwardly in the same direction, respectively, from said upper and lower areas of said vertical support portion, so that said support pad is formed by securing each of said vertical support portions of said two separate U-shaped members together with said upper support flange portions diametrically opposed from one another.

2. A load support device as in claim 1 wherein the angle of the beveled edge portions is about 10 degrees.

3. A load support device as in claim 1 wherein the top extreme outer edge of said support pad is slightly rounded.

4. A load support device as in claim 1 wherein said support pad is formed from metal.

5. A load support device as in claim 4 wherein the metal is steel.

6. A load support device as in claim 4 wherein the metal is aluminum.

7. A load support device as in claim 1 wherein said support pad is formed from a plastic material.

8. A load support device as in claim 7 wherein said plastic material is reinforced.

9. A load support device as in claim 4 wherein the thickness of said support pad can vary from about 0.2 centimeters to about 1.0 centimeters.

10. A load support device as in claim 7 wherein the thickness of said support pad can vary from about 0.4 centimeters to about 1.5 centimeters.

11. A load support device as in claim 1 wherein said support pad is comprised of two separate pieces.

* * * * *